United States Patent [19]

Branham

[11] 3,943,646

[45] Mar. 16, 1976

[54] DISPLAY BOARD CONSTRUCTION

[75] Inventor: Norvel R. Branham, Stone Mountain, Ga.

[73] Assignee: Norvel R. Branham, Stone Mountain, Ga.

[22] Filed: Mar. 4, 1974

[21] Appl. No.: 447,987

[52] U.S. Cl. ..... 40/64 R; 35/24 A
[51] Int. Cl.² ..... G09F 11/30
[58] Field of Search..... 40/64 R, 63 R, 65; 35/7 A, 35/24 R, 24 A, 1.7 R, 1.7 A, 24 B, 24 C

[56] References Cited

UNITED STATES PATENTS

| | | | |
|---|---|---|---|
| 2,419,631 | 4/1947 | Curtenius | 35/24 R |
| 2,787,850 | 4/1957 | Ware, Jr. | 35/24 A X |
| 3,162,174 | 12/1964 | Whyte | 35/24 A |
| 3,168,787 | 2/1965 | Surrey | 35/7 A |
| 3,419,979 | 1/1969 | McVicker et al. | 35/24 A |
| 3,522,666 | 8/1970 | Sarthou | 35/24 A |

FOREIGN PATENTS OR APPLICATIONS

| | | | |
|---|---|---|---|
| 1,406,138 | 6/1965 | France | 40/63 R |
| 1,583,420 | 9/1969 | France | 40/64 R |
| 6,402,354 | 9/1965 | Netherlands | 40/64 R |

*Primary Examiner*—John H. Wolff
*Attorney, Agent, or Firm*—B. J. Powell

[57] ABSTRACT

A display board construction including standards for mounting on a supporting surface, a plurality of carrier members extending between the standards generally normally oriented with respect thereto and connector assemblies removably and slidably mounting the carrier members on the standards. A display strip is removably carried in the carrier members to record data thereon and a dispenser is provided to refill the members with the strips.

9 Claims, 6 Drawing Figures

DISPLAY BOARD CONSTRUCTION

BACKGROUND OF THE INVENTION

Numerous display boards are available on the market today for displaying certain data for use in programming or scheduling. One of the problems with these prior art boards is their initial cost to the ultimate user. Another problem is that these boards usually have a finite capability for displaying data thus limiting the amount of material that can be displayed. Another problem is that these boards usually have a relatively heavy frame approximately the same size as the maximum display area of the board. This makes the board cumbersome to mount and use. Another problem with the prior art boards is the inability of the board to be quickly rearranged for different types of display. This has caused the user to maintain a substantial inventory of boards for use with different displays. Also, the prior art has, in many instances, been unable to have the projects thereon reordered as required without requiring a substantial number of man hours. Yet, another problem with prior art boards has been the inability to provide a permanent record once the project was complete.

SUMMARY OF THE INVENTION

These and other problems of the prior art are overcome by the invention disclosed herein by providing a display board which is extremely simple in construction, inexpensive to manufacture and extremely versatile in use. The board can be easily changed to display different data, can be expanded or contracted at will with only a minimum of time, and provides a permanent record of the project once completed. The display on the invention may be quickly reordered at will with a minimum of effort. The invention requires no large framework and is therefore extremely lightweight.

The display board of the invention comprises generally a plurality of standards to be mounted on a support surface such as a wall. A plurality of carrier members are positioned transversely of the standard by connector assemblies which removably engage the standards. The connector assemblies resiliently engage both the standards and the carrier members so that the carrier members and connector assemblies can be moved longitudinally along the standards and the carrier members can be moved with respect to the connector assemblies transversely of the standards. A flexible display strip is removably carried in the carrier members so that the display data can be recorded thereon. A dispenser unit may be provided for selective attachment to the end of the carrier member to dispense the display strip into the carrier member from a supply carried therein.

These and other features and advantages of the invention disclosed herein will become more apparent upon consideration of the following specification and accompanying drawings wherein like characters of reference designate corresponding parts throughout the several views and in which:

Figure 1:
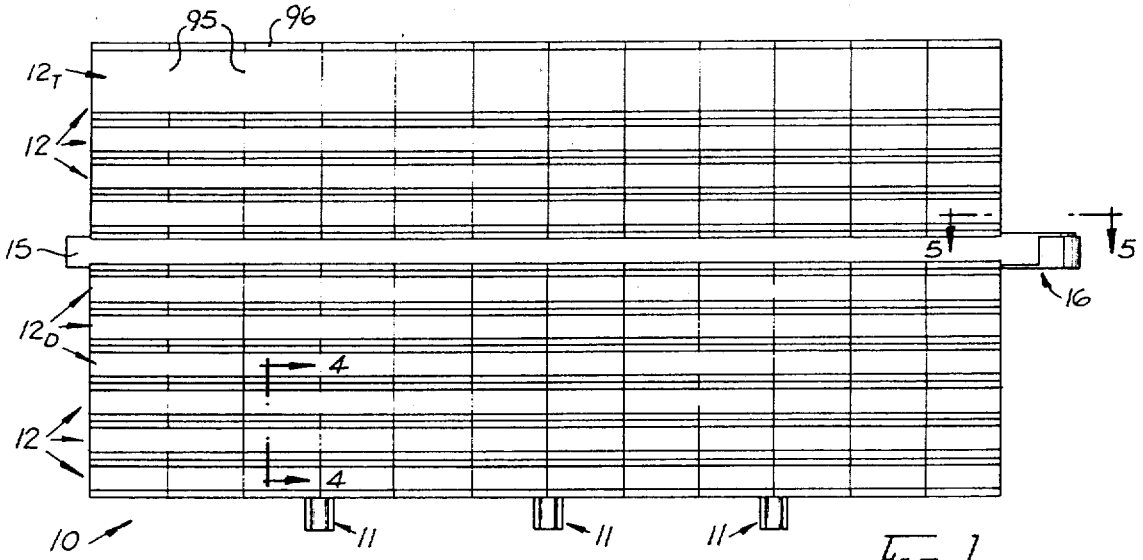
FIG. 1 is an elevational view of a display board embodying the invention.
Figure 2:
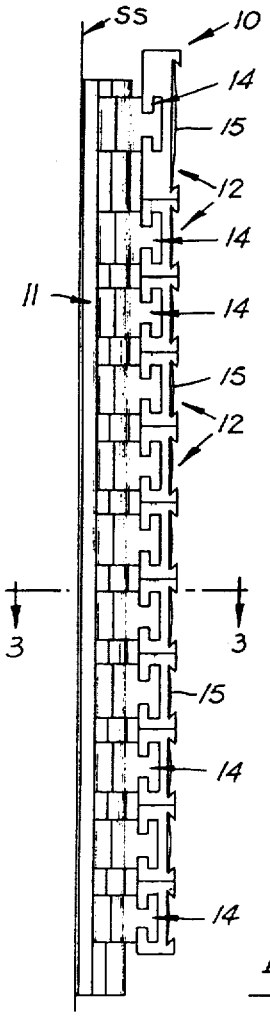
FIG. 2 is an enlarged end view of the board of FIG. 1.

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Referring to the drawings, it will be seen that the display board 10 includes generally a plurality of standards 11 for mounting on a supporting surface SS, a plurality of carrier members 12 extending between the standards 11, and a plurality of connector assemblies 14 interconnecting the members 12 and standards 11. A flexible display strip 15 is removably carried in each carrier member 12, and a dispenser unit 16 is provided which carries a supply of the display strip 15 and which is removably carried at one end of the carrier members 12 for dispensing the display strip 15 therefrom.

Figure 3:
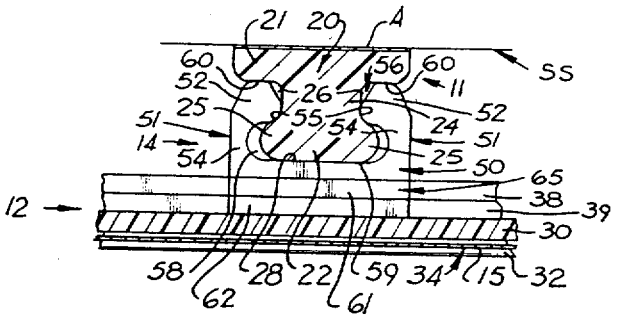
FIG. 3 is a partial enlarged cross-sectional view taken along line 3—3 in FIG. 2.

Each standard 11 as seen in FIG. 3 includes an elongated body 20 which provides a base 21 along its back edge extending along the length thereof. A forwardly projecting bulbous projection 22 extends along the length of body 20 and is connected to the base 21 through a reduced thickness section 24 integral with base 21 and projection 22. Ribs 25 are provided along opposite edges of projection 22 and recesses 26 are provided along opposite sides of the reduced section 24. The projection 22 defines a forwardly facing bearing surface 28 along the front thereof. The standard 11 may be attached to the supporting surface SS by any convenient means such as screws or an adhesive strip A shown in FIG. 3.

The carrier member 12 have generally the same construction although the width of the member may be varied to accommodate different width strips 15 as will become more apparent. Two different width members $12_T$ and $12_D$ are illustrated with member $12_T$ being wider for titles and members $12_D$ being narrower for data display, however, it is to be understood that such widths shown are in no way restrictive. Because all of the members 12 are similar, only one of the members $12_D$ will be described in detail with like numerals being applied to corresponding parts of all of the members 12.

Figure 4:
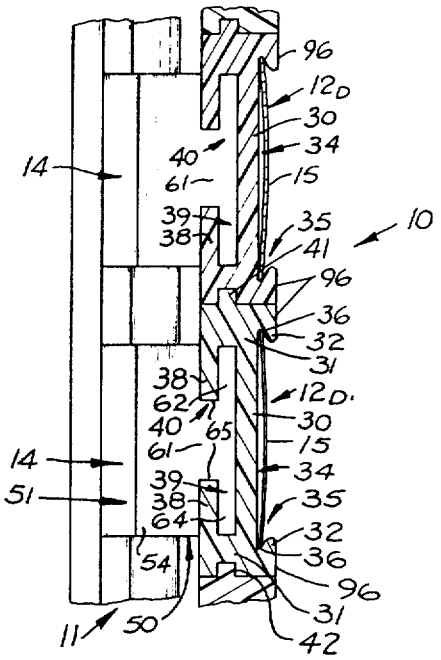
FIG. 4 is a partial enlarged cross-sectional view taken along line 4—4 in FIG. 1.

Referring now to FIG. 4, the member $12_D$ is a generally elongate member having a central upstanding web 30 with flanges 31 along the top and bottom edges of web 20 that extend both forwardly and rearwardly of the web 30. The forwardly extending edge of flanges 31 are provided with inwardly turned opposed lips 32 defining a strip receiving cutout 34 therebetween with a forwardly facing opening 35 thereto between the innermost edges of lip 32. The lips 32 define generally V-shaped upper and lower edges 36 in cutout 34 so that the strip 15 can be received therein as will become more apparent. The back edges of flanges 31 are provided with inwardly turned flanges 38 defining a channel 39 with a rearwardly facing opening 40 between the innermost edges of the flanges 38. The channels 39 are sized to slidably receive the connector assemblies 14 therein as will become more apparent. The upper edge of the top side flange 31 is provided with a centrally located tongue 41 which extends along the length of member 12 and the lower edge of bottom side flange 31 is provided with a groove 42 extending along the length of member 12. The tongues 41 and grooves 42 are complementary so that the tongue 41 of each member 12 is received in the groove 42 of the next higher member 12 while groove 42 of each member 12 receives the tongue 41 from the next lower member 12 as will become more apparent.

As best seen in FIGS. 3 and 4, each connector assembly 14 includes a generally rectangular main body 50 with a pair of rearwardly projecting opposed locking ears 51. The ears 51 have an enlarged locking tip 52 at the rearwardly projecting edge thereof and a reduced thickness section 54 connecting the tip 52 to body 50. The innermost edges 55 of tips 52 define an opening 56 therebetween to an enlarged width locking groove 58 between sections 54. The ears 51 are resilient so that the tips 52 can be snapped over the projection 22 of standard 11. This causes the ribs 25 of projection 22 on standard 11 to move within groove 58 of connector assembly 14. The edges 55 are resiliently urged into contact with the back edges of ribs 25 and the bearing surface 28 engages the complementary bearing surface 59 at the front of groove 58 in connector assembly 14. The rearwardly projecting edges 60 of tips 52 engage the base 21 of standard 11. Thus, it will be seen that the resiliency of ears 51 allow the connector assembly 14 to be snapped onto and off of the standard 11 at any position along its length. Further, it will also be noted that the connector assembly 14 can be forced to slide longitudinally along the length of standard 11 but the resiliency of ears 51 grip the standard 11 sufficiently to hold the connector assembly 14 in any position as will become more apparent.

The connector assembly 14 also includes a forwardly extending section 61 on the front of body 50. The section 61 is oriented generally normal to the longitudinal axis of ears 51 and is shown horizontal. The section 61 is sized to be slidably received through the opening 40 on the back of carrier member 12. Upwardly and downwardly extending flanges 62 and 64 are provided on the front end of section 61 sized to be slidably received in the channel 39 on the back of carrier member 12. The recesses 65 defined by the body 50, flange 62 or 64 and the section 61 along the top and bottom of connector assembly 14 slidably receive the flanges 38 of the member 12 therein. Thus, the connector assembly 14 slides into engagement with the back of carrier member 12 and supports same generally normal to the standard 11 when the connector assembly 14 is snapped into place on the standard as will become more apparent.

The display strip 15 is a thin elongate flexible member shown as extending the full length of the carrier member 12 although it is understood that the strip 15 may be of any convenient length. The strip 15 is slipped along the cutout 34 in carrier member 12 manually. The width of the strip 15 is slightly greater than that of cutout 34 so that the natural resiliency of strip 15 forces the upper and lower edges of the strip into the V-shaped edges 36 of cutout 34. This allows the strip 15 to be maintained in place but remain removable as will become more apparent. It will be noted, however, that the width of the strip 15 is such that the amount of curvature in the strip across its width is minimal so that the user can write on the strip after it is in place. While a wide variety of materials may be used for strip 15, the strip illustrated is paper.

Figure 5:
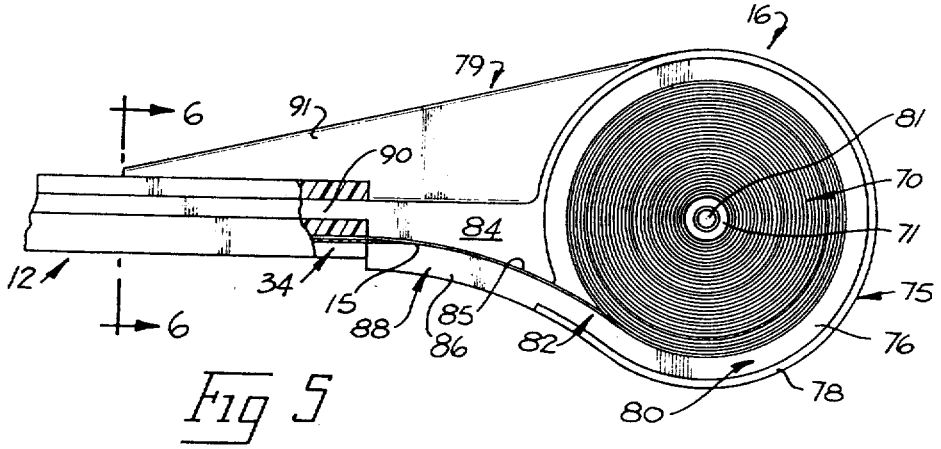
FIG. 5 is an enlarged top view of the dispenser unit taken along line 5—5 in FIG. 1; and, FIG. 6 is a cross-sectional view taken along line 6—6 in FIG. 5.
Figure 6:
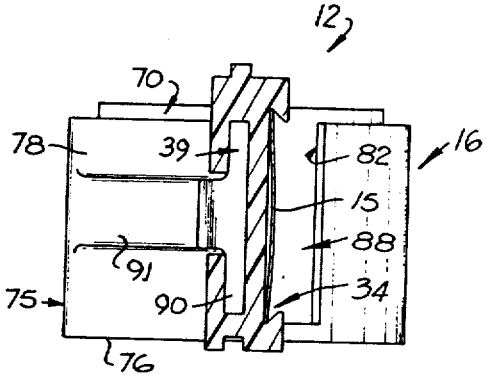

The dispenser unit 16 is best seen in FIGS. 5 and 6. The units 16 is designed to be removably mounted on the end of carrier member 12 and carry a supply of the strip 15, illustrated as a roll 70 wound on a core 71 to facilitate replacement of the strip 15. The unit 16 includes a generally clyindrical housing 75 having a bottom 76 and a generally circular side wall 78 on the top thereof. A projection 79 connects housing 75 with the end of member 12. The bottom 76 and side wall 78 define an upwardly opening generally circular pocket 80 in housing 75 for receiving the roll 70 therein. A locating pin 81 is provided in the bottom of pocket 80 to locate the roll 70 in the pocket by engaging the central passage through core 71 so that roll 70 can be rotated as the strip 15 is unwound from roll 70. A dispensing opening 82 is provided through wall 78 so that strip 15 can be dispensed therethrough as roll 70 is unwound in a clockwise direction as seen in FIG. 5. An abuttment 84 extends from side wall 78 toward member 12 and provides a curved guide surface 85 in alignment with the cutout 34 in member 12 at one end and opening 82 at its other. The bottom 76 has an extension 86 that projects forwardly of abuttment 84 along its length to provide a forwardly and upwardly opening guide passage 88 along which strip 15 is moved from roll 70 to cutout 34. The front opening to the passage 88 allows the user to manually unwind strip 15 from roll 70 and start it into cutout 34. The abuttment 84 includes a tang 90 that slidably fits into the channel 39 on the back of carrier member 12 to support unit 16 thereon. A reinforcing rib 91 connects tang 90 and abuttment 84 to side wall 78. The rib 91 is sized to project through the opening 40 to channel 39 when unit 16 is in place.

OPERATION

It will be noted that the board 10 lends itself to sale in kit form. For instance, a user would buy as many standards 11, carrier members 12, and connector assemblies 14 that he felt was needed. He would then mount the standards 11 on the supporting surface SS on spacing he felt was adequate for the board. He would then either cut the carrier members 12 to the desired length or have obtained precut lengths. The appropriate number of connector assemblies 14 are then slipped into channels 39 on members 12 and the connector assemblies 14 snapped into place on the standards 11. After the desired number of members 12 have been mounted, the basic board 10 is complete. Next, the strips 15 are installed in cutouts 34 on members 12. The dispenser unit 16 may be used to assist in this operation.

After strips 15 are installed, the appropriate division markings 95 may be made. It will be noted that each of the lips 32 on members 12 are provided with a write-on surface 96. This allows the user to write in the appropriate titles on the strip 15 carried by the carrier member $12_T$. Then the user draws the markings 95 across the strips 15 and write-on surfaces 96 to make the board 10 ready for use. The appropriate data is then recorded on strips 15 in members $12_D$ and the board used in normal manner. The members $12_D$ may be reordered as desired simply by removing any selected member 12, sliding the other members 12 to make room for the removed member, and then replacing the removed member in the created place.

When a project is complete, the strip 14 with the recorded data thereon for that project can be removed from member 12, folded to a convenient size, and retained in the file associated with that project.

While specific embodiments of the invention have been disclosed herein, it is to be understood that full use may be made of modifications, substitutions and equivalents without departing from the scope of the inventive concept.

I claim:

1. A display board construction adapted to be mounted on a generally vertical support surface for use in displaying certain data comprising:

at least two generally vertically oriented standards, and means for mounting said standards on the support surface in spaced apart parallel positions with a first prescribed distance therebetween, each of said standards including a pair of laterally opposed ribs parallel to each other extending along the length thereof generally vertically and parallel to the support surface;

a plurality of elongate carrier members, each of said carrier members having a length greater than said first prescribed distance between said standards and further having a front side, a back side, and a longitudinal centerline, each of said carrier members being horizontally oriented so that the centerline of each of said carrier members is generally perpendicular to said standards, each of said carrier members including a pair of opposed, spaced apart carrier flange members parallel to each other extending along the length of the back side of each of said carrier members, each of said carrier members further defining a strip carrier cutout along the length of the front side of each of said carrier members;

at least two connectors, each of said carrier members having a different connector connecting said carrier member to each of said standards, each of said connectors having a forward end and a rear end, and comprising a pair of opposed, spaced apart connector flange members on the forward end of each of said connectors oriented along a first axis lying in a first plane and a pair of spaced apart, opposed resilient ears on the rear end of each of said connectors oriented along a second axis lying in a second plane where the second axis is perpendicular to the first axis and the second plane is perpendicular to the first plane, one of said connectors connecting each of said carrier members to each of said standards so that each of said carrier members has a plurality of connectors associated therewith with one connector associated with each of said standards, said connector flange members of each of said connectors slidably engaging said carrier flange members of one of said carrier members so that each of said connectors is slidably movable along the length of said carrier member, and said ears of each of said connectors resiliently engaging said opposed ribs on one of said standards to mount said connector on said standard so that each of said connectors can be selectively removed from said standard on which said connector is mounted by forcing said ears from over said ribs and so that said connector can be selectively and slidably moved along the length of said standard; and, a plurality of flexible elongate strips, and means whereby each of said flexible elongate strips is removably carried along said cutout in each of said carrier members and onto which the date is recorded for display so that the display board can be assembled in any convenient size using said standards, said carrier members and said connectors by slidably mounting the same number of said connectors on each of said carrier members as the number of said standards to be used, slidably positioning said connectors along the length of each of said carrier members until each of said connectors aligns with one of said standards, and then connecting each of said connectors to one of said standards; and so that the order of said carrier members on said standards can be rearranged by individually removing any selected one of said carrier members and selectively sliding said carrier members still carried by said standards along said standards until the desired rearrangement is reached.

2. The display board construction of claim 1 further including a strip dispenser removably attached to one end of one of said carrier members and a roll of said strip rotatably mounted in said dispenser, said dispenser including guide means for directing said strip into said cutout in said carrier member as said strip is unwound from said roll.

3. The display board construction of claim 2 wherein said strip dispenser further includes a support member slidably received between said second flange members of said carrier member to support said dispenser on the end of said carrier member.

4. The display board construction of claim 3 wherein said dispenser includes a cylindrical housing, said housing including a generally circular bottom wall and an arcuate side wall connected to the peripheral edge of a portion of said bottom wall and a locating pin carried by said bottom wall for rotatably supporting said roll of said strip.

5. The display board construction of claim 1 wherein said connectors each further includes a body having a forward end and a rear end, said ears connected to and extending from the rear end of said body and said connector flange members connected to the forward end of said body opposite said ears; and, a recess defined between said body and each of said connector flange members, said carrier flange members on one of said carrier members slidably received in said recesses.

6. The display board construction of claim 5 wherein each of said carrier members includes a central web extending along the length thereof; and, wherein said opposed carrier flange members include a pair of edge flanges extending from and connected to opposite edges of said central web and oriented generally normal to the plane of said web, and a pair of inwardly turned flanges having innermost edges, one of said inwardly turned flanges joined to the projecting end of each of said edge flanges and extending along the length thereof; each of said inwardly turned flanges spaced from said central web a presecribed distance to define a connector receiving channel along the length of said carrier member, said inwardly turned flanges defining an opening of a prescribed width between the innermost edges thereof, said connector flange members of one of said connectors slidably carried in said connector receiving channel.

7. The display board construction of claim 6 wherein each of said ears of each of said connectors has a projecting end, includes an enlarged locking tip at the projecting end thereof, and includes a reduced thickness section resiliently connecting said locking tip to said connector so that said locking tips on said opposed ears resiliently engage said opposed ribs of one of said standards.

8. The display board construction of claim 7 wherein said central web of each of said carrier members includes a pair of opposed lips along opposite edges thereof defining said strip carrier cutout therebetween on that side of said central web opposite said carrier flange members, said cutout having a first prescribed width; and wherein each of said flexible elongate strips has a second prescribed width slightly greater than said first prescribed width of said cutout, each of said strips being resilient so that said strip can be slidably positioned in said cutout and the resiliency of said strip will hold said strip in said cutout so that the data can be recorded thereon for display.

9. The display board construction of claim 8 wherein said carrier members are located generally parallel to each other, each of said carrier members further defining a groove along one edge thereof facing an adjacent carrier member and a tongue along the opposite edge thereof facing an adjacent carrier member, said tongue on each of said carrier members received in said groove of the adjacent of said carrier members to interconnect adjacent said carrier members.

* * * * *